United States Patent [19]

Rattay et al.

[11] 4,428,484

[45] Jan. 31, 1984

[54] PORTABLE WINE BOTTLE CARRIER

[76] Inventors: Rosemary C. Rattay; M. Joan Rattay, both of 4942 N. Sedgewick, Lyndhurst, Ohio 44124

[21] Appl. No.: 340,836

[22] Filed: Jan. 19, 1982

[51] Int. Cl.[3] ..... B65D 5/48; B65D 25/06

[52] U.S. Cl. ..... 206/548; 206/593; 383/2; 383/38; 383/121

[58] Field of Search ..... 150/1.7, 2.5, 30, 52 R; 206/548, 127, 593; 220/22.1, 22; 229/42, 56, 15; 190/51

[56] References Cited

U.S. PATENT DOCUMENTS

| | | | |
|---|---|---|---|
| D. 266,048 | 9/1982 | Zills | 150/52 R |
| 2,335,016 | 11/1943 | Lorenzen et al. | 220/22 |
| 2,746,506 | 5/1956 | Howard | 150/52 R |
| 2,800,223 | 7/1957 | Kirk | 220/22 |
| 3,306,513 | 2/1967 | Fishman | 229/15 |
| 3,963,102 | 6/1976 | Carp | 190/51 |
| 4,127,155 | 11/1978 | Hydorn | 150/1.7 |

*Primary Examiner*—William T. Dixson, Jr.
*Assistant Examiner*—Brenda J. Ehrhardt
*Attorney, Agent, or Firm*—Maky, Renner, Otto & Boiselle

[57] ABSTRACT

A portable wine bottle carrier is characterized by a tote bag having a non-rigid bottom and sides and an open top, and a cushion divider for dividing the interior of the bag into two vertical compartments suitable for receipt of a wine bottle in each whereby bottles carried in the bag in the compartments are maintained in spaced, cushioned relationship. In one form of carrier, the cushion divider consists of a flexible padded tongue secured at its lower end to the bottom of the bag, which divides the bag into the vertical compartments or alternatively the divider may be adjusted or positioned to the side to accommodate a single wine bottle of standard or larger size. Also with the use of a larger size wine bottle, the tongue may be folded upon itself and on the bottom of the bag to provide a padded base support for the bottle. In another form of carrier, the cushion divider consists of an inverted T-shape cardboard insert. The stem of the insert divides the interior of the bag into the compartments whereas the base of the insert provides a cushioned bottom support for the bottles received in the compartments. In still another form of carrier, a vertical tongue dividing the interior of the bag into two compartments is secured to the sides of the bag along its vertical edges and has a top extension forming a flap or cover for one of the compartments. In any case, the bag is dimensioned to accommodate two regular standard size wine bottles in side by side relationship or a single standard or larger size wine bottle with the divider being adjusted or positioned to the side, folded onto the bottom of the bag or removed as required.

22 Claims, 14 Drawing Figures

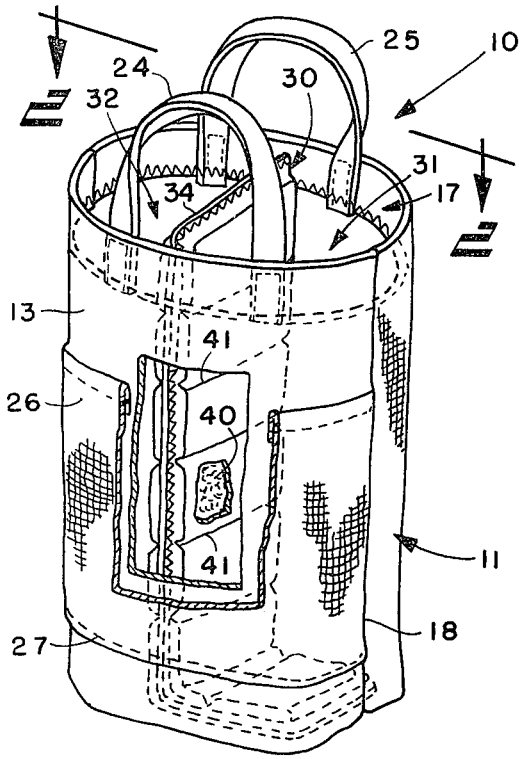
FIG. 1
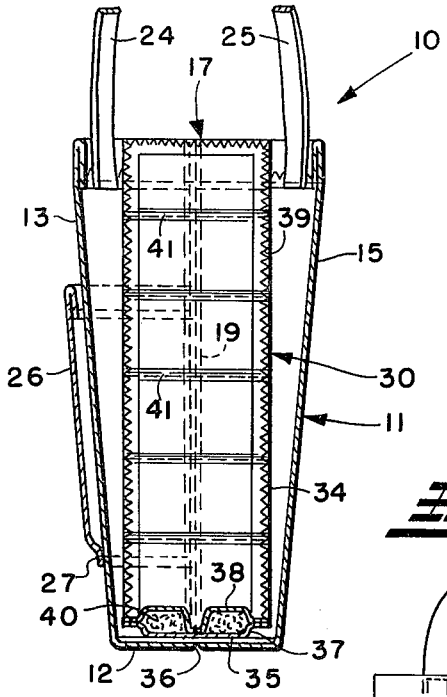
FIG. 3
FIG. 4
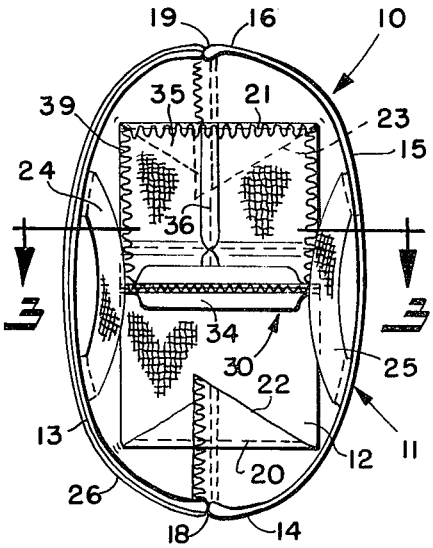
FIG. 2
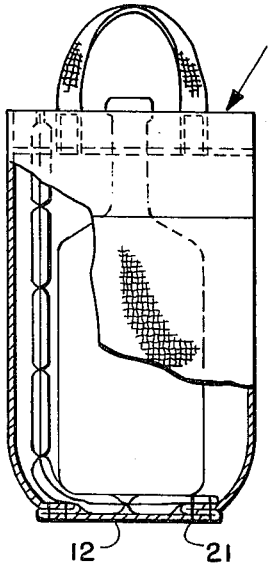
FIG. 5
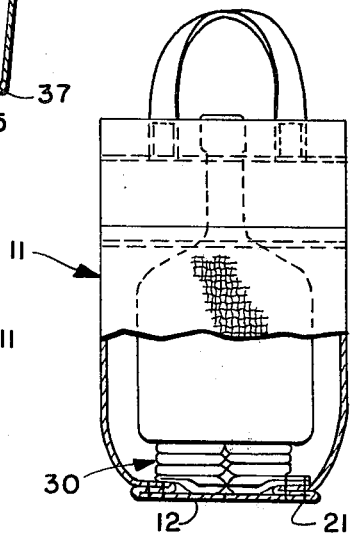
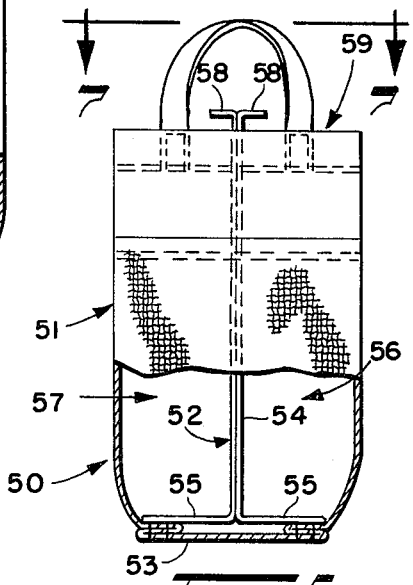
FIG. 6
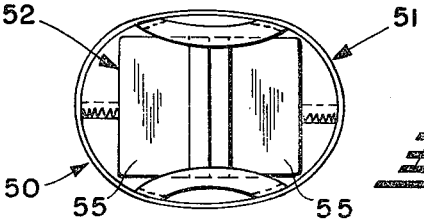
FIG. 7

PORTABLE WINE BOTTLE CARRIER

DISCLOSURE

This invention relates to portable wine bottle carriers and more particularly to a carrier suitable for porting one or two bottles of wine. As used herein, regular standard size refers to the more common and available sizes of wine bottles such as quart and liter bottles having substantially cylindrical bodies, whereas larger standard size refers to the less common and available larger sizes of wine bottles such as half-gallon and two-liter bottles.

BACKGROUND OF THE INVENTION

Heretofore, when carrying wine bottles in a paper bag, sack or the like, the glass wine bottles, unless restrained or held separated in the bag, may jostle against each other with the result that one or both bottles may break. Even if the bag is carefully handled to prevent breakage of the bottles, the bottles still may strike against each other such that a ringing or other irritating sound is produced. A need therefore exists for a portable wine bottle carrier which prevents breakage of the bottles being ported therein and/or which prevents the bottles from striking one another so as to eliminate any irritating sounds resulting therefrom. Such carrier desirably should be conveniently totable and adapted for carrying two standard size wine bottles or a single larger size bottle. The carrier also desirably should be aesthetically pleasing in appearance.

SUMMARY OF THE INVENTION

The present invention provides an aesthetically pleasing portable wine bottle carrier which maintains wine bottles carried therein in spaced, and preferably cushioned relationship so as to prevent the bottles from striking against each other thereby to preclude breakage of the bottles and any irritating sounds that would result from the bottles striking against one another. Briefly, the portable wine bottle carrier of the invention comprises a tote bag having a non-rigid bottom and sides and an open top, and divider means for dividing the interior of the bag into a pair of vertical compartments suitable for receipt of a wine bottle in each. In one form of carrier, the divider consists of a flexible padded tongue which is secured at its lower end to the bottom of the bag and preferably is quilted. The padded tongue divides the bag into the vertical compartments or alternatively the tongue may be adjusted or positioned to a side of the bag to accommodate a single bottle of regular or larger size. Also with the use of a larger size wine bottle, the padded tongue may be folded upon itself and on the bottom of the bag to provide a padded base support for the bottle.

The bottom of the bag preferably is generally rectangular and the tongue has a width equal about and parallel to the lesser dimension or width of the bag bottom. In a preferred construction, the bag has seams defining the union of the bottom and at least two opposed sides thereof and the padded tongue is secured to the bag at one of the side seams and additionally at the middle of the bottom of the bag. The bag is preferably formed from a single piece of fabric material such as cotton duck, such piece having a medial portion forming the bottom of the bag and end portions extending upwardly from the medial portion to form the sides of the bag, such end portions having vertical juxtaposed edges stitched together. In addition, a pair of handles are secured to opposed sides of the bag at the respective tops thereof whereby the bag is ported in a suspended state.

In another form of carrier according to the invention, the bag is similarly constructed but includes in place of the flexible padded tongue a rigid, inverted T-shape single or double-walled carboard insert which optionally may be covered by cloth and has a width about equal the width of the bag bottom. The base of the inverted T-shape insert has a length about equal that of the bag bottom and the stem extends upwardly therefrom to divide the bag into two vertical compartments. The top of the stem may have short laterally extending flanges or an opening therein such providing a convenient handle for facilitating removal of the insert when a single large bottle is to be carried in the carrier. When removed from the bag, the insert preferably is foldable flat for convenient storage purposes.

In still another form of carrier according to the invention, the divider is in the form of a vertical, non-rigid tongue which is secured to opposed sides of the bag along its vertical edges. The tongue preferably has a top extension extendable beyond the top of the bag which forms a flap or cover for one of the compartments formed by the tongue.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 1 is a perspective view of a portable wine bottle carrier constructed in accordance with the invention with portions thereof broken away for illustrative purposes, such carrier employing a flexible padded divider;

FIG. 2 is a top plan view of the carrier of FIG. 1 as seen from the line 2—2 thereof;

FIG. 3 is a vertical section through the carrier taken substantially on the line 3—3 of FIG. 2;

FIG. 4 is a front elevation of the carrier of FIG. 1 in an alternative arrangement suitable for carrying a single large size bottle of wine;

FIG. 5 is another alternative arrangement of the carrier of FIG. 1 suitable for carrying a single bottle of wine;

FIG. 6 is a front elevation, partly broken away, of another form of carrier constructed in accordance with the invention, such employing a rigid divider;

FIG. 7 is a top plan view of the carrier of FIG. 6 as seen from the line 7—7 thereof;

DETAILED DESCRIPTION

Figure 9:
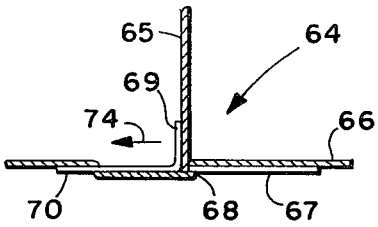
FIG. 9 is a vertical section through the rigid divider of FIG. 8 taken on the line 9—9 thereof.

Referring now in detail to the drawings and initially to FIGS. 1–3, a portable wine bottle carrier constructed in accordance with the invention is designated generally by reference numeral 10. The carrier includes a tote bag 11 having a non-rigid bottom 12, sides 13–16 and an open top indicated at 17. The bag preferably is formed from a single piece of fabric material such as cotton duck, such single piece of material having a medial portion forming the bottom 12 and end portions extending upwardly from the edges of such medial portion to form the sides of the bag, such end portions having vertical juxtaposed edges stitched together at seams 18 and 19.

As best seen in FIG. 2, the bag bottom 12 is generally rectangular and side seams 20 and 21 extending the width or lesser dimension of the bottom 12 define the union of the bottom 12 with the opposed bag sides 14 and 16, respectively. The side seams 20 and 21 further define inwardly folded, triangular shape gussets 22 and 23 which normally rest on the bottom 12 of the bag. The bag further includes a pair of handles 24 and 25 which consist of narrow, elongated strips of material. Such handles have their ends spaced apart laterally in relation to the bag and secured to the front and rear sides 13 and 15 of the bag at the upper ends thereof, respectively, so as to form a pair of upwardly extending loops.

The bag 11 also desirably includes a front pocket flap 26 which forms an outer slip pocket with the front side 13 of the bag. The pocket flap 26 may be secured along its bottom edge to the front side 13 at a seam 27 and may have its vertical side edges secured by the seams 18 and 19 between the juxtaposed vertical edges of the end portions of the fabric piece forming the sides of the bag. The top edge of the pocket flap may be folded over and stitched as indicated, but is not secured to the front side 13 whereby items may be placed into the pocket formed by the pocket flap and front side of the bag.

Still referring to FIGS. 1–3, the carrier 10 further includes a cushioned divider in the form of a flexible padded tongue 30 which divides the interior of the bag into a pair of vertical compartments 31 and 32. The flexible padded tongue 30 has an upper portion 34 and a laterally extending lower portion 35 secured at its distal end to the bottom 12 of the bag by the side seam 21. The lower portion 35 extends from the side seam 21 to about the middle of the bottom 12 and may be further secured to the bag bottom by a center seam 36. Such center seam 36 runs laterally from the side seam 21 to about the middle of the bag bottom whereby the tongue thusly is secured to the middle of the bag bottom and may extend upwardly therefrom to divide the interior of the bag into the two compartments 31 and 32 of substantially equal size.

The tongue 30 may be formed from a pair of facing sheets 37 and 38 of a suitable material such as nylon fabric which are secured together about their juxtaposed peripheral edges by overcast stitching as indicated at 39. The space 40 formed between the facing sheets may be filled with a suitable type fiber filling to provide the weight needed for cushioning and the tongue desirably is quilted by horizontal stitching as indicated at 41 to keep the filling in place. It thus can be seen that the quilted tongue may effectively cushion, isolate and separate bottles received in the compartments 31 and 32. The tongue also may be of a heavy durable material such as cotton duck as long as such material provides enough of a cushion comparable to the quilted material.

As best seen in FIG. 3, the tongue 30 has a width about equal the lesser dimension or width of the bag bottom 12. In addition, the tongue extends widthwise in relation to the bag bottom, i.e., parallel to the width of the bag bottom. Although the front and rear sides 13 and 15 may, as shown, billow out away from the vertical peripheral edges of the tongue when the bag is resting on a support and not picked up by its handles 24 and 25, such sides normally will be drawin closely adjacent the peripheral vertical edges of the tongue when the bag contains a wine bottle or wine bottles therein and is lifted by its handles 24 and 25.

In using the carrier to carry two standard size wine bottles, the free or upper portion 34 of the tongue 30 is oriented vertically to define the vertical compartments 31 and 32 so that the wine bottles may be received respectively in the compartments and supported on the bag bottom 12. The carrier may then be lifted at its handles 24 and 25, such drawing the sides 13-16 into close contiguous relationship with the bottles and serving to hold the bottles in the bag. At all times during use, the bottles are maintained in spaced, cushioned relationship by the tongue 30. Accordingly, the bottles are prevented from striking against one another thereby to prevent any breakage and undesirable noise that otherwise may result therefrom.

Referring now to FIG. 4, an alternative arrangement of the tongue 30 in the bag 11 is shown for use with a single wine bottle which may be larger than a regular standard size bottle. In this arrangement, the tongue is folded upon itself on the bag bottom 12 so as to provide a cushioned support for the bottle received in the bag. In another alternative arrangement seen in FIG. 5, the tongue may simply be adjusted or positioned to one side of the bag as indicated to permit insertion of a single bottle therein. Preferably, the tongue is adjusted or positioned to the side opposite the side seam 21 securing the tongue in the bag so as to provide a fully cushioned, but single layer, base support for the bottle.

Referring now to FIGS. 6 and 7, another form of carrier is designated generally by reference numeral 50. The carrier 50 includes a tote bag 51 constructed similarly to the bag 11 of the carrier 10 and a cushioned divider in the form of an inverted T-shape insert 52. The inverted T-shape insert is of a rigid or stiff wall construction and may be formed from any suitable stiff or rigid material adequate to cushion wine bottles against breakage while being toted in the bag.

Figure 7A:
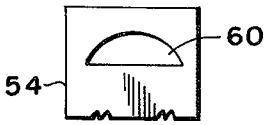
FIG. 7A is a fragmentary side elevation of the top of a modified form of rigid divider similar to that of FIGS. 6 and 7.

As shown, the inverted T-shape insert 52 may be constructed from two sheets of double walled corrugated cardboard having a width about equal the width or lesser dimension of the bag bottom 53. The cardboard sheets are secured together such as by a suitable adhesive along the stem 54 of the insert and folded at the bottom thereof to form oppositely extending horizontal arms 55. The arms 55 together have a total length about equal the greater dimension or length of the bag bottom and are supported on the bag bottom as indicated. Accordingly, the bottom arms provide a cushioned base support for bottles received in the two compartments 56 and 57 defined by the stem of the insert. Also as seen in FIGS. 6 and 7, the top ends of the cardboard sheets may be folded laterally outwardly to form oppositely extending short arms or flanges 58 which provide a convenient handle for facilitating removal of the insert from the bag. The short arms together have a length substantially less than the greater dimension of the open top 59 of the bag to permit insertion of the bottles through such open top into the compartments 56 and 57. Alternatively, in place of the flanges 58, the top of the stem 54 in a modified form may have a half-moon opening 60 as seen in FIG. 7A.

Figure 8:
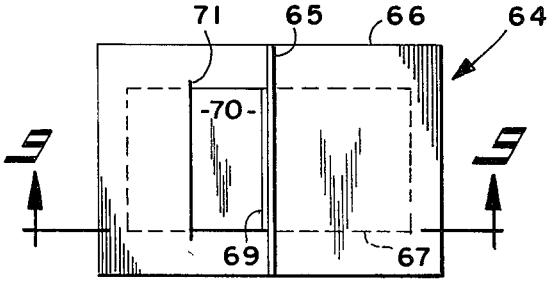
FIG. 8 is a top plan view of another form of rigid divider.

In FIGS. 8 and 9, another form of inverted T-shape, rigid insert is designated generally by reference numeral 64 and includes a stem piece 65 and a base piece 66 which may be made from single or double walled cardboard. The lower end of the stem piece 65 has a reduced thickness end portion or tab 67 which extends horizontally through a slot 68 in the base piece 66 at the center thereof. The stem piece also has secured to its lower end the vertical leg 69 of another reduced thickness tab 70 which extends horizontally and oppositely to the tab 67 through another slot 71 in the base piece.

With the stem and base pieces 65 and 66 interlocked as indicated, the insert 64 may be inserted into a tote bag in the same manner as the insert 52 is inserted in the bag 51. When thusly inserted, the stem piece divides the interior of the bag into two compartments for receipt of a wine bottle in each. If the wine bottles are of different size or if a single large wine bottle is to be carried in the bag, the stem piece can be shifted longitudinally in relation to the base piece to make one compartment larger and the other smaller as required, it being appreciated that the tabs 67 and 70 are slidable in their respective slots as indicated by the arrow 74 in FIG. 9.

Figure 10:
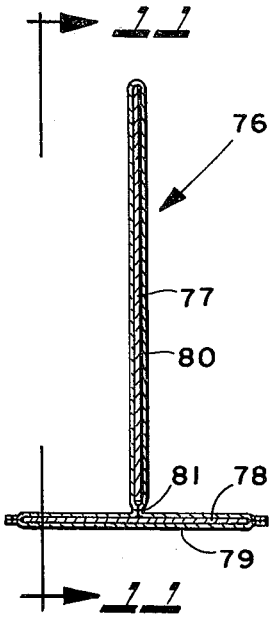
FIG. 10 is a vertical section through still another form of rigid divider.
Figure 11:
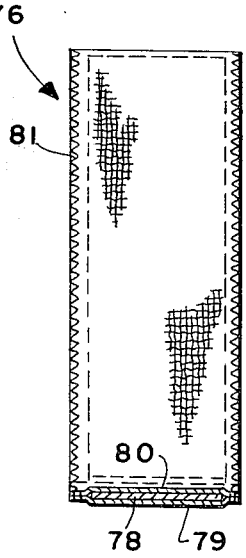
FIG. 11 is another vertical section through the rigid divider of FIG. 10 taken on the line 11—11 thereof.

Referring now to FIGS. 10 and 11, still another form of inverted T-shape, rigid insert can be seen at 76. The insert 76 includes a stem piece 77 and a base piece 78 which may be made of single or double walled cardboard. The stem and base pieces are arranged to form an inverted T as shown in FIG. 10 and interconnected by facing strips 79 and 80 which preferably are of cloth such as cotton duck. The facing strip 79 overlies the underside of the base piece whereas the facing strip 80 overlies the top side of the base piece and also both sides of the stem piece, such facing strip 80 being reversely folded at the top of the stem piece. The facing strips further have their edges extending beyond adjacent edges of the stem and base pieces and juxtaposed edges of the strips on opposite sides of the stem and base pieces are secured together by overcast stitching as indicated at 81. In addition, the opposed portions of the facing strip 80 at the bottom of the stem piece may be secured together at a seam to form a flexible cloth web 81 interconnecting the stem and base of the inverted T-shape insert.

It will be appreciated that the inverted T-shape inserts 52, 64 and 76, when removed from the bag, are each foldable flat for convenient storage purposes. That is, each insert may be folded at the union of the stem and base thereof such that the stem and base lie against each other. In the insert 76, the flexible web 81 particularly facilitates such folding.

Figure 12:
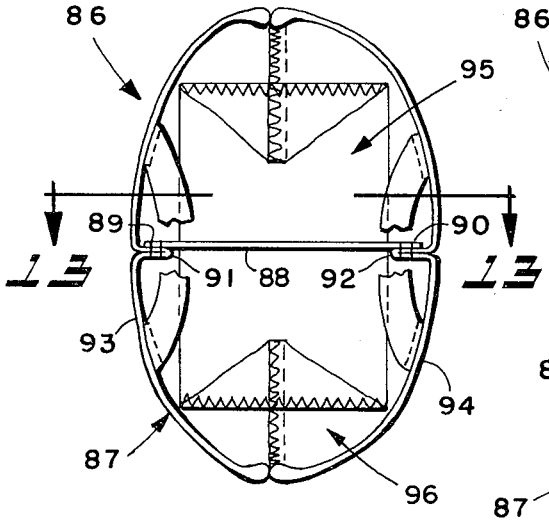
FIG. 12 is a top plan view of still another form of carrier according to the invention.
Figure 13:
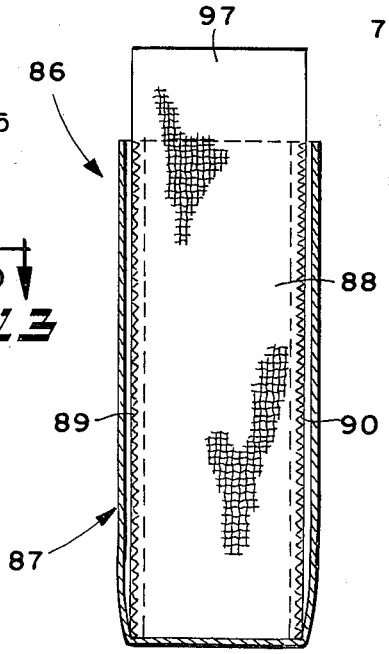
FIG. 13 is a vertical section through the carrier of FIG. 12 taken on the line 13—13 thereof.

Referring now to FIGS. 12 and 13, another form of carrier is shown at 86. The carrier 86 includes a tote bag 87 constructed similarly to the bag 11 of the carrier 10 and a divider in the form of a flexible divider strip 88. The divider strip 88 preferably is of fabric material and is secured at its vertical edges by seams 89 and 90 to inwardly folded center portions 91 and 92 of the opposed front and rear sides 93 and 94 of the bag, respectively. The divider strip accordingly divides the interior of the bag into two compartments 95 and 96, and the divider strip may have a free or unsecured top extension 97 which forms a flap or cover for one of the compartments.

In any of the various forms of carrier, the tote bag preferably is dimensioned to receive therein two regular standard size wine bottles. Preferably, the width of the bottom of the bag is about $3\frac{1}{2}$ inches whereas the length or greater dimension of the bag bottom is about $5\frac{3}{4}$ inches. Accordingly, the opposed front and rear sides are of a greater width than the other two opposed sides. Although the bottom of the bag is generally rectangular in shape, the open top 57 of the bag generally will be oval in shape and its circumference preferably is about 18 inches. It has been found that a bag dimensioned as indicated also will accommodate most larger standard and available sizes of wine bottles with the divider removed or positioned accordingly.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A portable wine bottle carrier comprising a tote bag having a non-rigid bottom and sides and an open top, and divider means dividing the interior of the bag into a pair of vertical compartments suitable for receipt of wine bottles, respectively, said divider means including a flexible padded tongue held at its lower end to the bottom of said bag, whereby bottles carried in the bag in said compartments are maintained in spaced, cushioned relationship.

2. A carrier as set forth in claim 1 wherein said flexible padded tongue is quilted.

3. A carrier as set forth in claim 1 wherein said tongue has facing sheets made of durable material.

4. A carrier as set forth in claim 1 wherein said tongue is readily foldable and adjustable to a side of said bag to accommodate a single larger size bottle.

5. A carrier as set forth in claim 1 wherein said bottom is rectangular and said tongue has a width equal about and parallel to the lesser dimension of said bottom.

6. A carrier as set forth in claim 1 wherein said bag has side seams defining the union of said bottom end at least two opposed sides thereof, and said tongue is secured to the bag at one of said side seams.

7. A carrier as set forth in claim 1 wherein said tongue is secured to the bag at the middle of said bottom.

8. A carrier as set forth in claim 1 wherein said bag is formed from a single piece of fabric material having a medial portion forming said bottom and end portions extending upwardly from the edges of said bottom to form said sides, said end portions having vertical juxtaposed edges stitched together.

9. A carrier as set forth in claim 8 wherein said material is a durable fabric material.

10. A carrier as set forth in claim 1 wherein said bottom is rectangular, and said tongue forms the stem of an inverted T-shape insert having a width about equal the lesser dimension of said bottom and a base having a length about equal the greater dimension of said bottom.

11. A carrier as set forth in claim 1 wherein said tongue is readily foldable upon itself on said bottom of said bag selectively to provide a cushioned bottom support for a bottle received in said bag.

12. A carrier as set forth in claim 1 including a pair of handles secured to opposed sides of said bag at respective upper portions thereof, whereby such opposed sides will be drawn into close contiguous relationship with the bottles upon lifting said bag by said handles, such serving to hold the bottles in said bag.

13. A carrier as set forth in claim 12 wherein each handle includes a narrow elongated strip of material secured at its ends to the respective sides of said bag.

14. A carrier as set forth in claim 1 wherein said tongue forms the stem of an inverted T-shape insert.

15. A carrier as set forth in claim 14 wherein said insert further includes a base piece and means interconnecting said tongue and said base piece to form a T.

16. A carrier as set forth in claim 15 including fabric facing strips for base piece.

17. A carrier as set forth in claim 15 wherein said base piece is constructed from cardboard.

18. A carrier as set forth in claim 1 wherein said tongue is secured at its vertical edges to opposed sides of said bag.

19. A carrier as set forth in claim 18 wherein said tongue has a free end extending above the top of said bag and forming a cover flap for one of said compartments.

20. A carrier as set forth in claim 1 wherein said bag is made from flexible fabric material.

21. A portable wine bottle carrier comprising a tote bag having a non-rigid bottom and sides and an open top, and divider means for dividing the interior of the bag into a pair of vertical compartments suitable for receipt of wine bottles, respectively, whereby bottles carried in the bag in said compartments are maintained in spaced relationship, said divider means consisting of an inverted T-shape rigid insert, said insert including a stem piece and base piece and means interconnecting said stem and base pieces to form a T, said means interconnecting including oppositely extending tabs on said stem piece and respective slots in said base piece for said tabs.

22. A carrier as set forth in claim 21 wherein said tabs are slidable in said slots for shifting said stem piece longitudinally in relation to said base piece.

* * * * *